US010247056B2

(12) United States Patent
Zschieschang

(10) Patent No.: US 10,247,056 B2
(45) Date of Patent: Apr. 2, 2019

(54) CAMSHAFT ADJUSTING DEVICE

(71) Applicant: Schaeffler Technologies AG & Co. KG, Herzogenaurach (DE)

(72) Inventor: Torsten Zschieschang, Hagenbuechach (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 49 days.

(21) Appl. No.: 15/126,954

(22) PCT Filed: Jan. 12, 2015

(86) PCT No.: PCT/DE2015/200001

§ 371 (c)(1),
(2) Date: Sep. 16, 2016

(87) PCT Pub. No.: WO2015/144141

PCT Pub. Date: Oct. 1, 2015

(65) Prior Publication Data

US 2017/0089227 A1 Mar. 30, 2017

(30) Foreign Application Priority Data

Mar. 26, 2014 (DE) ..... 10 2014 205 567

(51) Int. Cl.
*F01L 1/34* (2006.01)
*F01L 1/344* (2006.01)

(52) U.S. Cl.
CPC ... *F01L 1/3442* (2013.01); *F01L 2001/34426* (2013.01); *F01L 2001/34463* (2013.01)

(58) Field of Classification Search
CPC ..... F01L 1/3442; F01L 2001/34463; F01L 2001/34426
(Continued)

(56) References Cited

U.S. PATENT DOCUMENTS 7,841,311 B2 * 11/2010 Hutcheson ..... F01L 1/047 123/90.15
8,752,516 B2 6/2014 Takada
(Continued)

FOREIGN PATENT DOCUMENTS

CN 103109050 A 5/2013
CN 103485853 A 1/2014
(Continued)

*Primary Examiner* — Ching Chang
(74) *Attorney, Agent, or Firm* — Davidson, Davidson & Kappel, LLC

(57) ABSTRACT

A camshaft adjusting device including —a vane cell adjuster and —a central locking device (26) for locking the rotor (17) with respect to the stator (16), wherein —at least one first valve functional pin (46) is provided in the rotor hub (30), and the working chambers (20, 21, 22, 23) with different directions of action can be fluidically connected to one another via said valve functional pin, —in a first switch position, the first valve functional pin (46) fluidically connects at least two first working chambers (20, 21) with different directions of action to each other via a non-return valve (9, 10) during a movement from the direction "early" or "late" into the central locking position, —in a second switch position, the first valve function pin (46) fluidically separates the at least two first working chambers (20, 21) with different directions of action, —a bridging line (50) is provided for a fluid-free connection of the two first working chambers (20, 21), and —the bridging line (50) can be switched by a valve pin (45).

10 Claims, 3 Drawing Sheets

(58) Field of Classification Search
USPC ..... 123/90.15, 90.17
See application file for complete search history.

(56) References Cited

U.S. PATENT DOCUMENTS

| | | | |
|---|---|---|---|
| 8,820,280 | B2 | 9/2014 | Smith |
| 2005/0219087 | A1 | 10/2005 | Chang et al. |
| 2005/0219092 | A1 | 10/2005 | Chang et al. |
| 2011/0067657 | A1 | 3/2011 | Strauss |
| 2012/0073531 | A1 | 3/2012 | Urushihata |
| 2013/0180481 | A1 | 7/2013 | Kato et al. |
| 2013/0333647 | A1 | 12/2013 | Watanabe et al. |

FOREIGN PATENT DOCUMENTS

| | | | |
|---|---|---|---|
| DE | 102005011916 | A1 | 10/2005 |
| DE | 102008011915 | A1 | 9/2009 |
| DE | 102008011916 | A1 | 9/2009 |
| DE | 102012013510 | | 3/2013 |
| DE | 102013207616 | | 10/2014 |
| JP | 2000345815 | A | 12/2000 |
| JP | 2009299643 | | 12/2009 |
| JP | 2011163270 | A | 8/2011 |
| JP | 2012072674 | A | 4/2012 |
| WO | WO2012094324 | | 7/2012 |

* cited by examiner

CAMSHAFT ADJUSTING DEVICE

The present invention relates to a camshaft adjusting device having.

Camshaft adjusting devices are generally used in valve trains of internal combustion engines in order to alter the valve opening and closing times, as a result of which the consumption values of the internal combustion engine and the operating behavior may generally be improved.

BACKGROUND

One specific embodiment of the camshaft adjusting device proven in practice includes a vane cell adjuster with a stator and a rotor, which delimit an annular space, which is subdivided by projections and vanes into multiple working chambers. The working chambers may be selectively acted upon by a pressure medium, which is fed in a pressure medium circuit via a pressure medium pump from a pressure medium reservoir into the working chambers on one side of the vanes of the rotor and is fed from the working chambers on the respective other side of the vanes back to the pressure medium reservoir. The working chambers, the volume of which is increased in the process, exhibit an operating direction which is opposite the operating direction of the working chambers, the volume of which is reduced. Accordingly, the operating direction means that a pressure medium acting upon each group of working chambers causes the rotor to rotate either clockwise or counterclockwise relative to the stator. The pressure medium flow, and therefore the adjusting movement, is controlled, for example, with the aid of a central valve having a complex structure of flow-through openings and control edges and a valve body displaceable in the central valve, which closes or unblocks the flow-through openings as a function of its position.

One problem with such camshaft adjusting devices is that in a start phase they are not yet completely filled with pressure medium and may even be run dry, so that the rotor may carry out uncontrolled movements relative to the stator due to the alternating torques exerted by the camshaft, which may result in increased wear and an undesirable noise generation. To avoid this problem, it is known to provide a locking device between the rotor and the stator, which locks the rotor in a rotation angle position relative to the stator favorable for starting when the internal combustion engine is turned off. In exceptional cases, however, for example, when the internal combustion engine stalls, it is possible that the locking device does not lock the rotor as intended, and it is necessary to operate the camshaft adjuster in the subsequent start phase with an unlocked rotor. However, since some internal combustion engines have a very poor start behavior when the rotor is not locked in the center position, the rotor must then be automatically rotated and locked in the center locking position in the start phase.

Such an automatic rotation and locking of the rotor relative to the stator is known, for example, from DE 10 2008 011 915 A1 and from DE 10 2005 011 916 A1. The locking devices described in both publications include a plurality of spring-loaded locking pins, which lock successively in locking slots provided on the sealing cover or on the stator when the rotor is rotated and, in the process, allow the rotor in each case to rotate in the direction of the center locking position before reaching the center locking position, but which block a rotation of the rotor in the opposite direction. After the internal combustion engine is warmed up and/or the camshaft adjuster is filled completely with pressure medium, the locking pins, activated by the pressure medium, are forced out of the locking slots so that the rotor may be subsequently rotated as intended for adjusting the rotation angle position of the camshaft relative to the stator.

One disadvantage of this approach is that the rotor can be locked only with multiple successively locking locking pins, which results in higher costs. In addition, the locking process presupposes that the locking pins lock successively in a functionally reliable manner. If one of the locking pins fails to lock, the locking process may be interrupted, since the rotor is therefore not locked on one side in the intermediate position and may rotate back. In addition, it must be ensured that the locking pins may be reliably forced out of the locking slots during a start of the internal combustion engine.

SUMMARY OF THE INVENTION

An object of the present invention is to provide a camshaft adjuster which includes a functionally reliable and cost-effective center locking of the rotor.

According to the basic concept of the present invention, it is provided that a bridging line is provided for a fluidically-free connection of the first two working chambers, the bridging line being switchable by a valve pin. The first two working chambers are two working chambers of differing operating directions, which are used to automatically move the rotor from a direction "early" or "late" into the center locking position. For this purpose, the two first working chambers are fluidically connected to one another via a check valve during the movement of the rotor from the direction "early" or "late" into the center locking position when the internal combustion engine is switched off. A check valve having a first operating direction or a second operating direction is fluidically switched between the first working chambers as a function of whether the rotor is moved from the direction "early" or "late" into the center locking position. In this way, it is ensured that only one of the first working chambers increases its volume and thus enables the movement of the rotor relative to the stator only in the direction of the center locking position. When restarting the internal combustion engine, the locking pins must be moved again out of the locking slot. This is achieved by the application of a pressure medium to the locking slot, causing the locking pin to move against the spring force back into the rotor hub. At the same time, one of the first two working chambers, as a result of the application of pressure medium, is acted upon by pressure medium, causing a torque to occur between the stator and the rotor; the remaining working chambers of different operating directions are fluidically short-circuited in this operating state by the first valve function pin. In this state, the locking pins have not yet been completely forced out of the locking slot, as a result of which at least one locking pin may jam on the locking slot as a result of the applied torque. Due to the clamping effect, the locking pin is unable to be moved or to be moved only belatedly out of the locking slot. With the bridging line according to the present invention, a direct fluidically free connection may be established in this state between the two first working chambers. A freely flowable pressure medium line in this context is understood to mean a pressure medium line, through which a pressure medium may flow unhindered or essentially unhindered in both flow directions; a pressure medium line with a check valve is therefore not freely flowable. No torque is created between the stator and the rotor in this operating state as a result of this fluidic short circuit, which is why the jamming of the locking pin on the locking slot is prevented. The bridging line in this case is controllable via a valve pin, the valve pin preferably being controllable by the pressure medium in the locking slot. The fluidic switching of the bridging line by a valve pin may ensure that the fluidic short circuit between the two first working chambers occurs only in the operating state in which a jamming is to be avoided, i.e., in the phase between the start of the internal combustion engine and normal operation. In all other operating states, the bridging line is not fluidically switched between the two first working chambers. The result of this is that a reliable unlocking from the center locking position is enabled during the start phase of the internal combustion engine.

It is provided that a recess for accommodating the valve pin is provided in the locking slot. The advantage of the recess on the one hand is that the valve pin may assume an additional valve position. On the other hand, the valve pin may be moved into two switching positions when the locking slot is switched to zero pressure. The valve pin with a front surface facing the locking slot initially drags along a bottom surface of the locking slot when the rotor is moved in the direction of the center locking position relative to the stator, until it reaches the point at which the recess is provided. There, the valve pin is pushed by the spring force into the recess and thereby assumes the additional switching position.

It is further provided that the recess is situated in a locking slot secured to the stator in such a way that the valve pin in the center locking position is movable with at least one end section into the recess. Thus, the specific arrangement of the recess offers the advantage that the additional switching position may only be reached in the center locking position. The additional switching position for the fluidically free connection of the two first working chambers via the bridging line need only occur in the center locking position during the start of the internal combustion engine.

It is further advantageous if the bridging line is switched fluidically open between the two first working chambers when the end section is located completely in the recess. This ensures that the two first working chambers are fluidically freely connected only if a sufficient pressure level is not yet reached in the locking slot and a jamming of the locking pins is possible. The spring force of the locking pins in such a case need not be identical to the spring force of the valve pin. The spring force of the valve pin is preferably greater than that of the locking pins. In this way, it is the locking pins that are first moved out of the locking slot. If the locking pins have been moved so far out of the locking slot that a jamming is no longer possible, the valve pin is also moved against the spring force and, as a result, the free fluidic connection between the first two working chambers is interrupted.

One end section of the valve pin projecting into the recess is preferably tapered in the direction of one end of the valve pin. The locking slot is not acted upon by pressure medium when the internal combustion engine is stopped, which is why, when the rotor is moved, the end of the valve pin drags from the direction "early" or "late" into the center locking position along the bottom surface until it has reached the recess. Because of the tapering, the frictional resistance between the end and the bottom surface is reduced and the penetration of the end section into the recess is facilitated.

The tapering of the end section is further preferably formed by a conical shape or spherical shape. A spherical or conical shape is simple and cost-effective to manufacture and offers the advantage that the transition between the bottom surface and the recess is not sudden, but rather occurs steadily. Inherent to this is also the advantage that the valve pin may be more easily moved out of the recess in the case of an adjusting movement between the rotor and the stator. Thus, the valve pin may be moved out of the recess by a hydraulic force as well as by a mechanical force.

It is advantageous if the shape of the recess is adapted to the outer contour of the end section in such a way that pressure medium is able to flow between the recess and the end section when the end section is located completely in the recess. This enables the valve pin to be moved by the pressure medium in the locking slot against the operating spring force out of the recess. Additional devices for again moving the valve pin out of the recess may therefore be omitted.

It is further preferred that the valve pin is formed by the first valve function pin. The valve function pin is already provided in the camshaft adjusting device and is controlled by the pressure medium level in the locking slot. Thus, with a minimal design change, it is possible to fluidically switch the bridging line between the two first working chambers as a function of the switching position of the valve function pin.

The first valve function pin in a third switching position preferably connects the first working chambers fluidically freely to one another via the bridging line. The third switching position of the valve function pin may only be reached if the camshaft adjusting device is located in the center locking position and, as a result, the valve function pin or the end section thereof may be moved into the recess. If the camshaft adjusting device is not in the center locking position, the valve function pin is then only able to assume the first or the second switching position. In the center locking position, the additional third switching position may only be reached if the valve function pin is not moved into the first or second switching position by the application of pressure medium in the locking slot.

The valve pin may also be formed by an additional second valve function pin. The second valve function pin may therefore be controlled independently of the first valve function pin. However, the second valve function pin is preferably also controllable via the pressure medium level in the locking slot. In this specific embodiment of the present invention, the second valve function pin preferably has two switching positions. In a first switching position of the second locking device, the free fluidic connection between the two first working chambers is blocked. The first switching position of the second locking device is reached if the second valve function pin or the end section thereof is not pushed into the recess. In a second switching position of the second valve function pin, the two first working chambers are fluidically freely connected to one another via the bridging line; the second valve function pin in this switching position is pushed into the recess.

BRIEF DESCRIPTION OF THE DRAWINGS

The present invention is described in greater detail below with reference to a preferred exemplary embodiment. In the individual figures, in particular.

DETAILED DESCRIPTION

Figure 1:
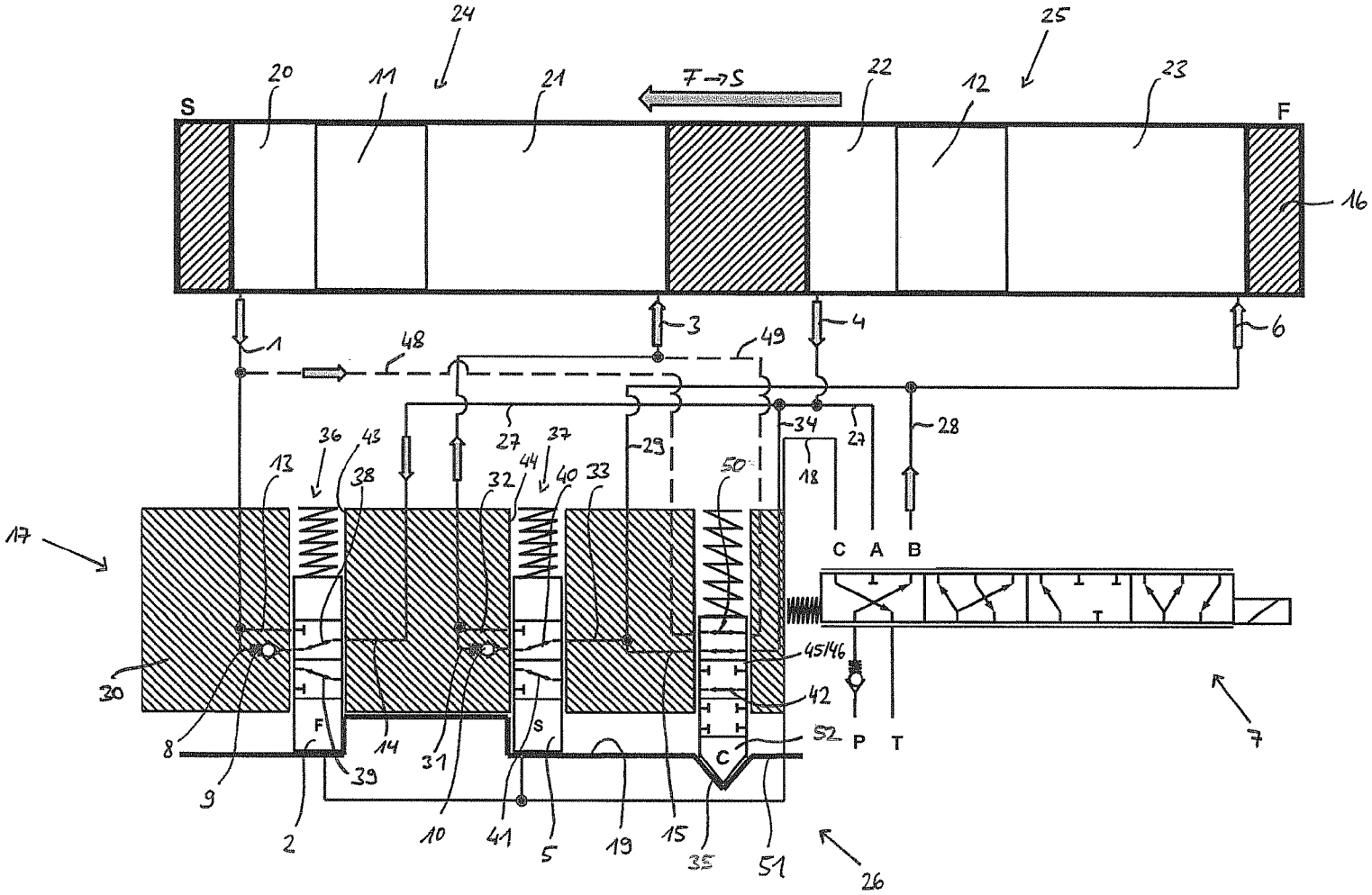
FIG. 1 schematically shows a representation of a camshaft adjusting device according to the present invention with a circuit diagram of a pressure medium circuit in the center locking position having a first valve function pin in a third switching position.
Figure 2:
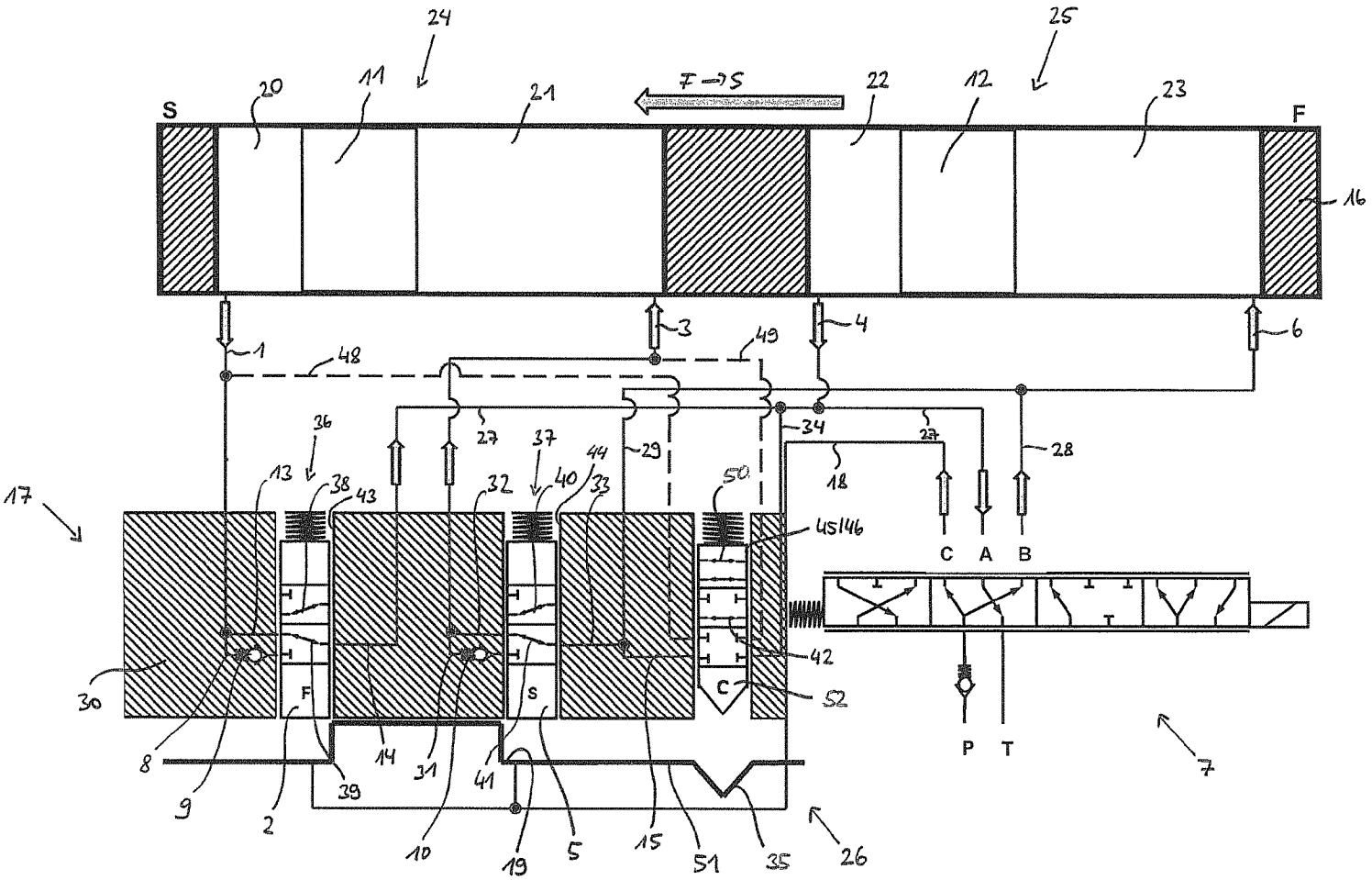
FIG. 2 schematically shows a representation of a camshaft adjusting device according to the present invention with a circuit diagram of a pressure medium circuit in the center locking position having a first valve function pin in a second switching position.
Figure 3:
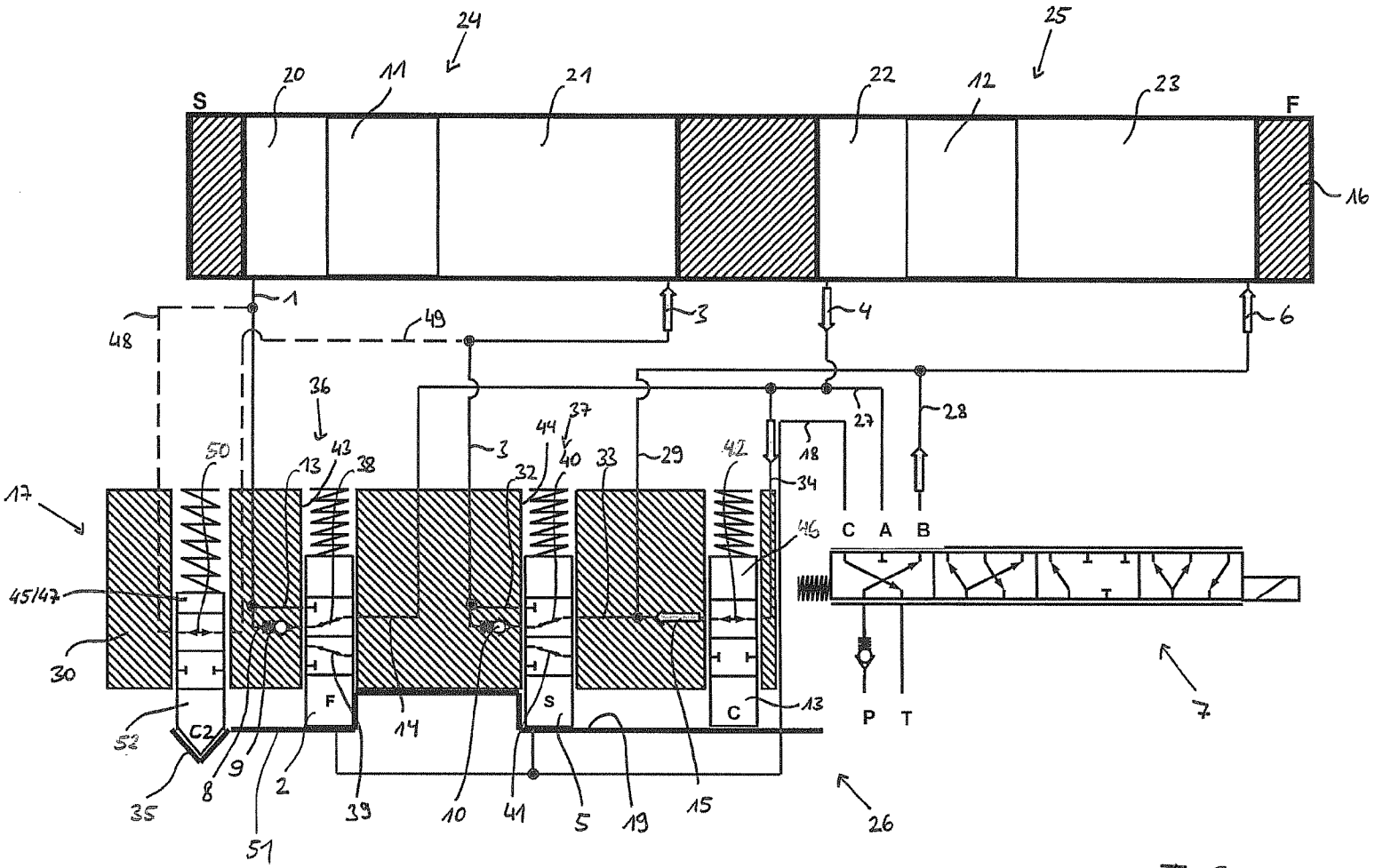
FIG. 3 schematically shows a representation of a camshaft adjusting device according to the present invention with a circuit diagram of a pressure medium circuit in the center locking position having an additional second valve function pin in a second switching position.

A camshaft adjusting device is apparent in FIGS. 1 through 3, having a known basic construction with a schematically depicted vane cell adjuster as the basic component, which includes a stator 16 drivable by a crankshaft not depicted and a rotor 17 rotatably fixedly connectable to a camshaft also not depicted having multiple vanes 11 and 12 extending radially outwardly therefrom. In the upper development drawing, the vane cell adjuster is apparent, whereas a detail of rotor 17 having a center locking device 26 is schematically apparent at the bottom left and a switching device in the form of a selector switch valve 7 for controlling the pressure medium flow is schematically apparent at the bottom right. Selector switch valve 7 includes an A-port, B-port and C-port, to which pressure medium lines 18, 27 and 28 are fluidically attached. In addition, selector switch valve 7 is fluidically connected to a pressure medium reservoir T and to a pressure medium pump P which, during an actuation of the camshaft adjusting device, conveys the pressure medium, once it is returned, again from pressure medium reservoir T in a pressure medium circuit.

A pressure medium circuit is also apparent having a plurality of pressure medium lines 1, 3, 4, 6, 8, 13, 14, 15, 18, 27, 28, 29, 31, 32, 33, 34, 38, 39, 40, 41, 42, 48 and 49, which are selectively fluidically connectable to pressure medium pump P or pressure medium reservoir T via selector switch valve 7.

Stator 16 includes a plurality of stator webs, which subdivide an annular space between stator 16 and rotor 17 into pressure chambers 24 and 25. Pressure chambers 24 and 25, in turn, are subdivided by vanes 11 and 12 of rotor 17 into working chambers 20, 21, 22 and 23, into which pressure medium lines 1, 3, 4 and 6 open. Center locking device 26 includes two locking pins 2 and 5, which are used for locking rotor 17 with respect to stator 16 in a locking slot 19 secured to the stator. Locking slot 19 may, for example, be situated in a sealing cover securely screwed to stator 16.

In principle, the rotation angle of the camshaft relative to the crankshaft during normal operation is adjusted in the direction "late," for example, by applying pressure medium to working chambers 21 and 23 and thereby increasing their volume, while at the same time forcing the pressure medium out of working chambers 20 and 22 and reducing their volume. The stop position "early" is marked in the depictions with an F, and the stop position "late" is marked with an S. Working chambers 20, 21, 22 and 23, the volume of which is increased each time in groups during this adjusting movement, are referred to within the context of the present invention as working chambers 20, 21, 22 and 23 of one operating direction, while working chambers 20, 21, 22 and 23, the volume of which at the same time decreases, are referred to as working chambers 20, 21, 22 and 23 of the opposite operating direction. The volume change of working chambers 20, 21, 22 and 23 then result in rotor 17 with vanes 11 and 12 rotating with respect to stator 16. In the upper development drawing of stator 16, the volume of working chambers 21 and 23 is increased by an application of pressure medium via the B-port of selector switch valve 7 during a movement from "early" to "late," whereas the volume of working chambers 20 and 22 is reduced at the same time by the backflow of the pressure medium via the A-port of selector switch valve 7. This volume change results in a rotation of rotor 17 with respect to stator 16, which results in a shift of the vanes 11 and 12, in the development drawing of FIG. 2 to the left, out of the shown center locking position.

FIGS. 1 and 2 show a first specific embodiment of the present invention, whereas a second alternative specific embodiment is shown in FIG. 3, the first specific embodiment being preferably used in practice.

In FIGS. 1 through 3, it is apparent that, according to the solution according to the present invention, a check valve 9 and 10, respectively, is situated in a rotor hub 30 of rotor 17 in spatial proximity to locking pins 2 and 5. Locking pin 2 is fluidically connected via pressure medium line 14 to pressure medium line 27. In addition, pressure medium line 1 is fluidically connected via pressure medium lines 8 and 13 to an accommodating space 43 of locking pin 2. Pressure medium lines 8 and 13 are fluidically connected in parallel. Pressure medium line 8 and 13 are fluidically connected to second pressure medium line 14 as a function of the switching position of a first valve device 36. Thus, the first valve device 36 is formed by accommodating space 43 and locking pin 2 guided therein. In a first switching position, first valve device 36 fluidically connects pressure medium line 8 to pressure medium line 14 via pressure medium line 38 (see FIG. 1). In a second switching position of first valve device 36, the fluidic connection between pressure medium line 13 and pressure medium line 14 is established via pressure medium line 39 (see FIG. 2). Check valve 9 in this case is situated in third pressure medium line 8, the operating direction of check valve 9 being such as to enable a through-flow of pressure medium in the direction of working chamber 20. This applies similarly to a second valve device 37, which is formed by locking pin 5 mounted in an accommodating space 44, accommodating space 44 being fluidically connected to pressure medium lines 33, 31 and 32. In a first switching position, second valve device 37 fluidically connects pressure medium line 31 to pressure medium line 33 via pressure medium line 40 (see FIG. 1). In a second switching position of second valve device 37, the fluidic connection between pressure medium line 32 and pressure medium line 33 is established via pressure medium line 41 (see FIG. 2). Pressure medium lines 31 and 32 in this case are fluidically connected in parallel. Check valve 10 is situated in pressure medium line 31, the operating direction of check valve 10 being set in such a way that a through-flow of pressure medium is possible only in the direction of working chamber 21. Alternatively to the arrangement of check valves 9 and 10 outside of locking pins 2 and 5 in rotor hub 30, these check valves may also be provided directly in first and/or second valve device 36 and 37.

FIG. 1 shows a camshaft adjusting device according to the present invention, in which a valve pin 45 for switching a bridging line 50 is formed by a first valve function pin 46. First valve function pin 46 is linearly displaceable and spring-loaded. It is also spring-loaded in the direction of the engagement position in locking slot 19 and is situated in rotor 17 in such a way that it does not hinder the rotational movement of rotor 17 with respect to stator 16. First valve function pin 46 is just moved along. To enable the adjustment of rotor 17 with respect to stator 16, center locking device 26 is first released by applying pressure medium via pressure medium pump P to locking slot 19 via pressure medium line 18 from the C-port of selector switch valve 7. Due to the application of pressure medium to locking slot 19, locking pins 2 and 5, as well as first valve function pin 46, are forced out of locking slot 19, so that rotor 17 may subsequently rotate freely with respect to stator 16.

FIG. 1 shows the camshaft adjusting device in a center locking position during the start of the internal combustion engine. Pressure medium pump P in this operating state is fluidically connected to the B-port of selector switch valve 7. The C-port of selector switch valve 7 in this switching position is fluidically connected to pressure medium reservoir T.

The adjusting movement of the rotor into the center locking position is described below. The adjusting movement described below is completed chronologically before the state depicted in FIG. 1. When rotor 17 is moved with respect to stator 16 from the direction "early" into the center locking position, first valve device 36 is in the second switching position, whereas second valve device 37 is in the first switching position. Thus, check valve 10 is switched between the two first working chambers 20 and 21 so that the excessive pressure medium is only able to flow from working chamber 20 into working chamber 21 and, as a result, a movement may take place in the direction of the center locking position. With this adjusting movement into the center locking position, locking slot 19 is switched to zero pressure, as a result of which first valve function pin 46 is moved by a spring force from a second switching position into a first switching position. In the first switching position, pressure medium line 15 is fluidically connected to pressure medium line 34 via pressure medium line 42, the fluidic connection between pressure medium lines 48 and 49 being blocked. In a second switching position, there is no fluidic connection between pressure medium lines 15 and 34 as well as between 48 and 49. As long as the camshaft adjusting device is not in the center locking position, first valve function pin 46 is held in the first switching position by a bottom surface 51 of locking slot 19. Thus, when rotor 17 is moved from the direction "early" into the center locking position, a fluidic connection is established between first working chambers 20 and 21 via pressure medium lines 1, 13, 39, 14, 27, 34, 42, 15, 33, 40, 31 and 3. The pressure medium in this case flows via check valve 10. The functional principle is to be applied similarly when rotor 17 is adjusted with respect to stator 16 from the direction "late" into the center locking position. First valve device 36 is then in the first switching position and second valve device 37 is in the second switching position. In this case, the flow from working chamber 21 into working chamber 20 takes place via pressure medium lines 3, 32, 41, 33, 15, 42, 34, 14, 38, 8 and 1. The pressure medium in this adjustment direction flows via check valve 9.

If the camshaft adjusting device is in the center locking position (see FIG. 1), then the backflow of pressure medium via check valve 9 and 10 is not possible. Thus, during a start of the internal combustion engine, the two first working chambers 20 and 21 are therefore fluidically freely connected via a bridging line 50. Remaining working chambers 22 and 23 are fluidically short-circuited via pressure medium line 42 in first valve function pin 46. During a start of the internal combustion engine, pressure is already applied by pressure pump P to working chambers 20, 21, 22 and 23 of one operating direction before locking pins 2 and 5 have been moved out of locking slot 19. Without additional bridging line 50, no pressure compensation could take place in first working chambers 20 and 21 due to check valves 9 and 10, which is why a torque is created between stator 16 and rotor 17. Locking pins 2 and 5 in this operating state project at least still partly into locking slot 19, which could result in a jamming of at least of one locking pin 2 or 5 with locking slot 19.

In a first specific embodiment according to the present invention, bridging line 50 is provided in first valve function pin 46, which may be fluidically connected between pressure medium lines 48 and 49 in an additional third switching position of first valve function pin 46, see FIG. 1. In this way, first working chambers 20 and 21 may be fluidically freely short-circuited via pressure medium lines 1, 48, 50, 49 and 3. A freely flowable pressure medium line in this context is understood to mean a pressure medium line, through which pressure media may flow unhindered or essentially unhindered in both flow directions; accordingly, a pressure medium line 8 or 31 with check valve 9 or 10 is not freely flowable. The result of this is that a jamming of locking pins 2 and 5 at locking slot 19 is prevented during the start of the internal combustion engine.

The third switching position of first valve function pin 46 may be reached only if an end section 52 of first valve function pin 46 projects into a recess 35 provided therefor. Recess 35 is situated in locking slot 19 in such a way that end section 52 is only able to project into it in the center locking position. During the adjusting movement of rotor 17 from the direction "early" or "late" into the center locking position, first valve function pin 46 is moved by the spring force into the first switching position and held there in this first switching position by bottom surface 51. Once the center locking position is reached, first valve function pin 46 is located at the position of recess 35, so that end section 52 is moved by the spring force into recess 35. End section 52 is tapered in the direction of the end of first valve function pin 46, preferably, with a spherical shape, even more preferably with a conical shape. In this way, a sudden transitional movement of end section 52 into recess 35 is avoided. In addition, the contour of recess 35 is configured in such a way that when an end section 52 is located completely in the recess, the pressure medium is able to flow from locking slot 19 between recess 35 and end section 52. This ensures that a force against the spring force is applied by the pressure medium to first valve function pin 46 and, as a result, the pin may be moved out of locking slot 19. The pretensioning force of the springs of locking pins 2 and 5 in this case may differ from the pretensioning force of first valve function pin 46. The pretensioning force of locking pins 2 and 5 is set preferably lower than that of valve pin 45. The result of this is that initially locking pins 2 and 5 are moved so far out of locking slot 19 that a jamming of locking pins 2 and 5 with locking slot 19 is prevented. Once locking pins 2 and 5 have been moved so far out of locking slot 19 that a jamming is ruled out, first valve function pin 46 moves into the second switching position, as a result of which pressure medium lines 48 and 49, as well as pressure medium lines 15 and 34 are fluidically blocked; this state is depicted in FIG. 2. Locking pins 2 and 5 in this operating state are also in the second switching position. Thus, all fluidic connections between working chambers 20, 21, 22 and 23 of different operating directions are blocked. Working chambers 21 and 23 are connected to pressure medium pump P via pressure medium lines 28 and 6, as well as pressure medium lines 28, 29, 33, 41, 32 and 3 via the C-port of selector switch valve 7. The excessive pressure medium of oppositely operating working chambers 20 and 22 may drain into pressure medium reservoir T via pressure medium lines 1, 13, 39, 14, 27 as well as via pressure medium lines 4 and 27 via the A-port of selector switch valve 7.

FIG. 3 shows a second specific embodiment of the present invention, in which valve pin 45 is formed by an additional second valve function pin 47. Accordingly, first valve function pin 46 assumes only the already known first and second switching position; the third switching position is omitted. Second valve function pin 47 also has two switching positions. In a first switching position, the fluidically free connection of pressure medium lines 48 and 49 is blocked. In a second switching position, a fluidically free connection between first working chambers 20 and 21 may be established via bridging line 50. In this way, the pressure medium may flow freely between first working chambers 20 and 21 via pressure medium lines 1, 48, 50, 49 and 3. Similar to first valve function pin 46, second valve function pin 47 may also reach the second switching position only if end section 52 of valve function pin 47 has been moved completely into recess 35. Recess 35 in this case is situated in locking slot 19 in such a way that it may be reached by second valve function pin 47 only in the center locking position. If the C-port of selector switch valve 7 is switched to zero pressure and the center locking position is reached, second valve function pin 47 in this specific embodiment is in the second switching position, and thus forms a fluidically free connection between first working chambers 20 and 21. At the same time, first valve function pin 46 is in the first switching position, as a result of which additional working chambers 22 and 23 having different operating directions are fluidically short-circuited. In this way, the blocking of the rotation of rotor 17 with respect to stator 16 is prevented during the freewheeling. The further functionality corresponds to that of the first exemplary embodiment from FIGS. 1 and 2. Thus, even in the second specific embodiment from FIG. 3, a jamming of locking pins 2 and 5 on locking slot 19 may be reliably prevented.

LIST OF REFERENCE NUMERALS

1 pressure medium line
2 locking pin
3 pressure medium line
4 pressure medium line
5 locking pin
6 pressure medium line
7 selector switch valve
8 pressure medium line
9 check valve
10 check valve
11 vane
12 vane
13 pressure medium line
14 pressure medium line
15 pressure medium line
16 stator
17 rotor
18 pressure medium line
19 locking slot
20 working chamber
21 working chamber
22 working chamber
23 working chamber
24 pressure chamber
25 pressure chamber
26 center locking position
27 pressure medium line
28 pressure medium line
29 pressure medium line
30 rotor hub
31 pressure medium line
32 pressure medium line
33 pressure medium line
34 pressure medium line
35 recess
36 valve device
37 valve device
38 pressure medium line
39 pressure medium line
40 pressure medium line
41 pressure medium line
42 pressure medium line
43 accommodating space
44 accommodating space
45 valve pin
46 first valve function pin
47 second valve function pin
48 pressure medium line
49 pressure medium line
50 bridging line
51 bottom surface
52 end section

The invention claimed is:

1. A camshaft adjusting device comprising:

a vane cell adjuster including a stator connectable to a crankshaft of an internal combustion engine;

a rotor rotatably mounted in the stator and connectable to a camshaft;

multiple webs being provided on the stator, the webs subdividing an annular space between the stator and the rotor into a plurality of pressure chambers, the rotor including a rotor hub and a plurality of vanes extending radially outwardly from the rotor hub, the plurality of vanes subdividing the pressure chambers into first working chambers of a first group and second working chambers of a second group, the first working chambers having a first operating direction, the second working chambers having a second operating direction different from the first operating direction, each of the first working chambers and the second working chamber being actable upon by pressure medium flowing into or out of a pressure medium circuit;

a center lock for locking the rotor hub in a locking position relative to the stator;

at least one first valve function pin being provided in the rotor, the first working chambers and the second working chambers being fluidically connectable to one another via the at least one first valve function pin, the at least one first valve function pin in a first switching position fluidically connecting at least one of the first working chambers to at least one of the second working chambers via a check valve with a movement from a direction "early" or "late" into a center locking position, and the at least one first valve function pin in a second switching position fluidically separating the at least one of the first working chambers and the at least one of the second working chambers from one another; and a line fluidically freely connecting the at least one of the first working chambers to the at least one of the second working chambers, the line being switchable via a valve pin.

2. The camshaft adjusting device as recited in claim 1 wherein a recess for accommodating the valve pin is provided in a locking slot.

3. The camshaft adjusting device as recited in claim 2 wherein the recess is situated in the locking slot secured to the stator in such a way that the valve pin is movable with at least one end section into the recess in the center locking position.

4. The camshaft adjusting device as recited in claim 3 wherein the line is switched fluidically open between the at least one of the first working chambers and the at least one of the second working chambers when the at least one end section is located completely in the recess.

5. The camshaft adjusting device as recited in claim 3 wherein the at least one end section of the valve pin projecting into the recess tapers in the direction of one end of the valve pin.

6. The camshaft adjusting device as recited in claim 5 wherein the tapering of the at least one end section is formed by a conical shape or spherical shape.

7. The camshaft adjusting device as recited in claim 3 wherein a shape of the recess is adapted to an outer contour of the at least one end section in such a way that pressure medium is able to flow between the recess and the at least one end section when the at least one end section is located completely in the recess.

8. The camshaft adjusting device as recited in claim 1 wherein the valve pin is formed by the at least one first valve function pin.

9. The camshaft adjusting device as recited in claim 8 wherein in a third switching position, the at least one first valve function pin fluidically freely connects the at least one of the first working chambers and the at least one of the second working chambers via the line.

10. The camshaft adjusting device as recited in claim 1 wherein the valve pin is formed by an additional second valve function pin.

* * * * *